United States Patent [19]

Spellman

[11] 4,105,366

[45] Aug. 8, 1978

[54] TWISTED FLEX FAN

[75] Inventor: Michael Thomas Spellman, Indianapolis, Ind.

[73] Assignee: Wallace Murray Corporation, New York, N.Y.

[21] Appl. No.: 723,108

[22] Filed: Sep. 14, 1976

Related U.S. Application Data

[62] Division of Ser. No. 576,728, May 12, 1975, Pat. No. 4,012,168.

[51] Int. Cl.[2] ..... F04D 29/38

[52] U.S. Cl. ..... 416/132 A; 416/240

[58] Field of Search ..... 416/132, 132 A, 240, 416/DIG. 3

[56] References Cited

U.S. PATENT DOCUMENTS

| | | | |
|---|---|---|---|
| 3,679,321 | 7/1972 | Strick | 416/132 A |
| 3,759,630 | 9/1973 | Freeman et al. | 416/240 X |
| 3,827,826 | 8/1974 | Strick | 416/132 A |
| 3,910,718 | 10/1975 | MacEwen et al. | 416/240 X |
| 3,914,069 | 10/1975 | Arrington et al. | 416/240 X |
| 4,012,168 | 3/1977 | Spellman | 416/132 A |

FOREIGN PATENT DOCUMENTS

| | | | |
|---|---|---|---|
| 962,244 | 2/1975 | Canada | 416/240 |

*Primary Examiner*—Everette A. Powell, Jr.
*Attorney, Agent, or Firm*—Thomas J. Greer, Jr.

[57] ABSTRACT

A fan blade construction for an automobile cooling system. The twist angle of the blade, as measured by the rotation of an imaginary line joining the leading and trailing edges, varies linearly or non-linearly along the length of the blade, the leading edge of the blade is rigid and the trailing edge of the blade is flexible. In another embodiment, the fan blade is resiliently biased against a portion of its mounting arm to inhibit flutter.

4 Claims, 5 Drawing Figures

TWISTED FLEX FAN

This is a division of application Ser. No. 576,728, filed May 12, 1975, now U.S. Pat. No. 4,012,168.

This invention relates to the art of impeller construction and more particularly to a fan blade construction displaying particular utility for cooling in the radiator system of an internal combustion engine. In the usual internal combustion engine a heat exchange fluid such as water or so-called permanent anti-freeze is pumped into and out of cavities or passages within the engine block and passes to a radiator coil. Air is moved by a fan over the radiator coil, thus cooling the coil and the liquid carried through it. The now cooled liquid is then returned to the engine block for the purpose of preventing extremely high temperature build-up of the engine block during operation. The cooling fan is generally driven by a belt coupled to the engine so that the cooling action of the fan takes place concurrently with operation of the engine.

A great variety of constructions for such cooling fans is known. Such variations include, for example, configurations or shapes of the fan blades as well as other variations which include variation of the degree of rotational coupling between the fan and the engine. Such variable coupling devices include shear type couplings which employ a shear liquid.

It is also known that a sheet metal fan blade may be so constructed as to exhibit a linear or non-linear twist angle. An example of a fan blade having a linear twist angle is shown in U.S. Pat. No. 1,444,923 to Kempton. One kind of a non-linear twist angle fan may be inferred from FIGS. 12 and 13 of U.S. Pat. No. 2,460,902 to Odor. The use of flexible blades on such automotive cooling systems is also known from, for example, U.S. Pat. No. 3,490,686, to Weir. The advantages of flexible fan blades, in certain applications, reside in their ability to bend and thus effectively change their pitch with increasing rotational speed. At higher engine speeds the cooling requirement of the fan is generally lower for the usual engines in a vehicle. Hence, flexing of the fan blade lessens the power lost to the fan, thus matching at such higher engine speeds the lower cooling requirement.

While both flexible blade fans and fan blades having a variable twist angle have been known, no one has until now recognized the advantages of a fan blade which exhibits a linear or a non-linear twist angle, in combination with a flexible trailing edge portion. Almost the entire blade itself, additionally, may be flexible provided that it has a stiffened or rigid leading edge. The advantages of this construction include better control of the amount and direction of the flex of the blades. Vibration of the blade is reduced and superior control of the angle of attack along the full length of the blade is realized.

It is known from U.S. Pat. No. 3,758,231 to Barnstead that a fan may be constructed wherein the individual blades are defined by a relatively stiff leading portion and a relatively flexible trailing portion separated by an intermediate region or junction. Barnstead discloses positioning the junction such that it is nearer to the leading edge at the outermost radial part than it is from the leading edge at the hub. While apparenlty satisfactory for the conditions of operation envisioned by Barnstead, I have found that by making the junction between the stiffened and the flexible blade portion nearer the leading edge at the hub and farther from the leading edge at the tip, i.e., opposite to Barnstead's construction, superior results are obtained. By this construction, more uniform airflow is obtained, less noise is encountered, and greater durability is enjoyed.

This invention also comprehends a novel mode of securing the blades to the spider arm of the hub, such that the blades are normally biased to resist centrifugal and air resistance forces tending to reduce their pitch.

This embodiment of the invention is directed to a construction for inhibiting rattling or flutter. It is known in the art of flexible fan blades (which are attached to relatively stiff portions) that the flexible portion may commence to flutter at certain rotational speeds. Such flutter is undesirable for a variety of known reasons. Prior workers in this art have attempted to overcome the problem of flexible blade flutter by the insertion of a spacer element between the spider arm and an adjacent portion of the flexible fan blade part. Such an additional element adds to the cost and expense of fabricating the fan. The prior art is also aware that flutter may be avoided by biasing a fan blade or a portion thereof. For example, in U.S. Pat. No. 2,132,132 to Smith, a hinged fan blade portion is biased by a coil spring against an abutment. The spring force is in opposition to centrifugal and air resistance forces tending to reduce the blade pitch. In U.S. Pat. No. 3,679,321 to Strick, a separate insert positioned between a flexible blade and a spider mounting arm is itself resilient and biases the flexible blade. While these and other arrangements may well have performed as intended, they are relatively expensive. In arrangements such as shown by Smith, a separate hinge and coil spring are required. In an arrangement of the type shown by Strick, a separate bias force producing member is required. The construction now to be described enjoys the advantages of a biased blade construction, yet without the usual expense and difficulty of construction. According to the novel construction, a portion of the flexible blade abuts an edge of the outermost part of the spider arm. During most of the operation of the fan, this abutting contact is made, the resilience of the flexible blade maintaining the contact. However, this contact is not made at all times. At high rotational speeds, centrifugal and air reaction forces will overcome the resilient force and cause the flexible part of the blade to move away from edge contact with the spider arm. Intermittant contact and non-contact during such high speed operations will often result. However, in distinction to prior art constructions, it has been found that notwithstanding such contact interruption, contact fan flutter is appreciably reduced and problems due to resonance fatique have been substantially eliminated.

IN THE DRAWINGS

Figure 1:
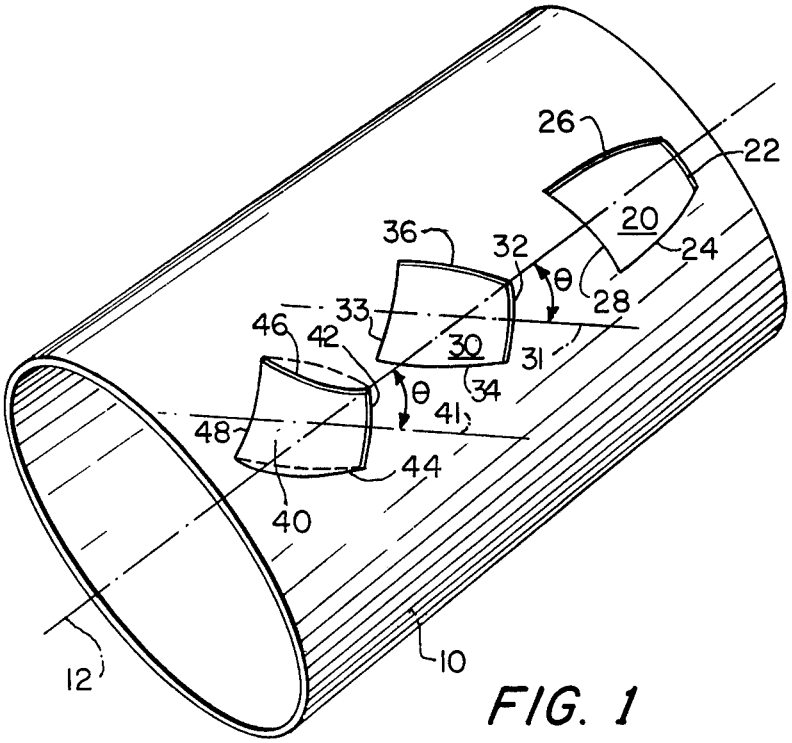
FIG. 1 is a partially schematic view illustrating the construction of the invention.

Referring now to the drawings, the numeral 10 denotes generally a cylinder which may be formed of sheet metal or other resilient material. The cylinder 10 may be circular or elliptical in cross-section. Further, the cylinder wall from which the blade may be considered formed may be a truncated cone or may not be a completed annular extent. Further, it may be of only partial arcuate or annular extent. Thus, the surface may be a surface of revolution in the nature of a paraboloid or a hyperboloid, or similar shape. The following description will describe the cylinder 10 as cylindrical, although it will be understood that the term "cylinder" as used here in the description is intended to embrace other such shapes, as above enumerated, as well.

The numeral 20 represents a fan blade formed by cutting out a generally trapezoidal or rectangular portion wherein the longitudinal axis of the blade 20 is parallel with the axis 12 of the cylinder 10. Such a blade 20 includes a tip portion 22, a leading edge 24, a trailing edge 26 and a hub portion 28. Such a blade is symmetrical about its mid-longitudinal axis, with the areas on either side towards the leading or the trailing edge being equal and of identical form.

The numeral 30 denotes another blade formed from cylinder 10 and is in general identical with the blade 20, save for the fact that its longitudinal axis 31 is at an angle theta with respect to the axis 12 of the cylinder. Such a blade 30 has a tip 32, a leading edge 34, a trailing edge 36, and a hub edge portion 33. Again, the blade 30 is symmetrical about its longitudinal axis 31. A similar blade is illustrated and described in U.S. Pat. No. 1,444,923, issued to Kempton.

The twist angle of either blade may be defined as follows. An imaginary line is drawn from the leading to the trailing edge, at any point along the length of the blade. The imaginary line is generally at right angles to the longitudinal axis of the blade. As the imaginary line is moved in a direction from the rotary hub to which the blade is attached to the tip of the blade, its twist or rotation with respect to the longitudinal axis is termed the twist angle. Thus, the first blade 20 will exhibit no variation of twist with respect to its length. The twist angle is then said to be zero.

However, with respect to blade 30, the offsetting of the axis 31 at an angle theta (greater than zero but less than 90°) yields a twist angle which changes linearily along the length of the blade. This variation will be linear in the sense that the amount of rotation of the imaginary line per unit of length along axis 31 will be the same at all points along this axis. This property is exhibited by the blade shown in the Kempton patent.

Still another, third, blade, 40, exhibits a non-linear twist angle. The blade has a tip 42, a leading edge 44, a trailing edge 46, and a hub or base portion 48. The longitudinal axis 41 of the blade is (as the second blade) at an angle theta with respect to the axis 12 of the cylinder 10, with theta being greater than zero but less than 90°. The dashed lines indicate the blade configuration if the areas on both halves of the longitudinal axis 41 had been the same as the second blade 30. The solid lines 44 and 46 represent the actual blade edges and it is seen that the blade 40 may be regarded as similar to the blade 30, but with, for example, leading edge 44 in the shape of a circular curve and trailing edge 46 being straight. Such a construction is shown in the above-mentioned Odor patent. An imaginary line generally at right angles to axis 41 and joining the leading and trailing edges will rotate a different number of degress for every unit of length traversed along axis 41. Accordingly, the twist angle is said to be non-liner.

In view of the above explanation, the reader will now be in a position to comprehend the general form of construction of a fan blade having both a linear and a non-linear twist angle. It will be understood that the cylinder 10 is illustrated and employed in the claims as a reference basis for purposes of explanation. Any of the three types of blades 20, 30, 40 may be formed as by stamping, rolling, etc., and may be of two components as well as by cutting from a cylinder. A description will now be given of a specific embodiment of the present invention.

Figure 2:
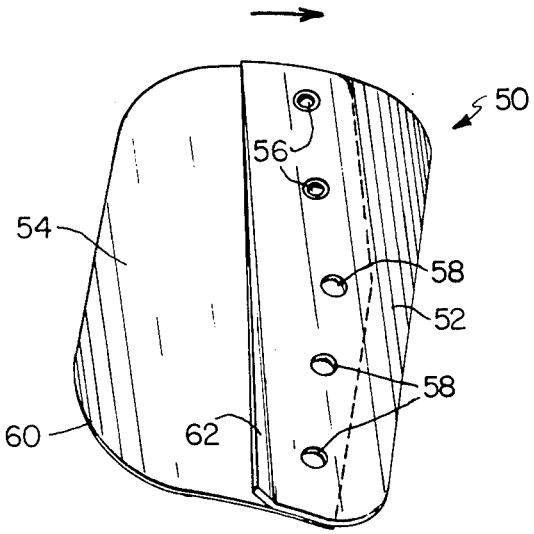
FIG. 2 is a perspective view of one face of a fan blade according to this invention.
Figure 3:
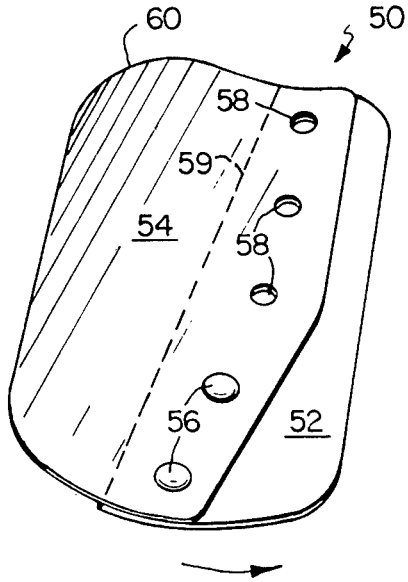
FIG. 3 is a view similar to FIG. 2 of the other face.

Referring now to FIGS. 2 and 3 of the drawings, the numeral 50 denotes a fan blade which may possess either a linear or a non-linear twist angle. The blade comprises in general two portions, a rigid portion 52 formed of relatively thick and hence rigid sheet material of, for example, 1/16 inch thickness metal and a relatively thin portion 54 of, for example, 1/32 inch thickness or less. These two portions are joined as by rivets 56 and include apertures 58 which are adapted to secure, as by rivets or bolts, the blade to an arm of a rotatable hub element. A plurality of such blades secured to the so-called spider arms of the rotatable hub element define a fan, the direction of rotation indicated by the arrow. The portion 54 is relatively flexible so that during operation of the fan the pitch of the blade will vary with increasing speed of rotation of the hub. Thus, at higher engine speeds, when not as much air for cooling is required, the pitch of the fan effectively changes (is lessened) due to the bending or flexing of portion 54. Referring to FIG. 3, the action would be such that the portion 60, at higher rotational speeds of the fan, would be forced by centrifugal force and the reaction of the air to move into the plane of the paper (away from the reader) and to thus effectively reduce the pitch. This in turn results in an expenditure of lower horsepower and accordingly greater efficiency for the entire automobile engine. As noted at FIG. 2, the rigid portion 52 may include a triangular portion 62 which is bent in the direction indicated along the edge to facilitate flexing. Again referring to FIG. 2, the portion 60 would, in the case of higher fan speeds, bend upwardly towards the reader.

In practice, the fan blade 50 is formed of the two indicated portions, a rigid portion for the leading edge and a flexible portion for the trailing edge. It will be understood, however, that the invention includes the case of a cooling requirement application wherein the entire blade may be flexible or of single piece construction wherein the leading edge is thicker and the trailing edge thinner and more flexible. The blade and blade portions may be fabricated by forming a flat sheet metal blank of the desired configuration and then curving it as by passing through a set of rollers. Alternatively, such blades or blade portions may be formed by stamping a flat blank over a curved mandrel or die. The intersection or juncture of the rigid and flexible portions of the blade is a narrow zone and is indicated by the dashed line 59 in FIG. 3 and is at the lower edge of the triangular portion 62 of FIG. 2. Referring now to FIG. 1, this intersection would be defined on blade 30 by a line parallel to axis 12, which line appears as 12 on blade 30. It is also to be observed that, in operation of the blade, the intersection of the rigid and flexible portions, i.e., such as the dashed line of FIG. 3, lies in a plane parallel to the plane of rotation of the fan blade.

Figure 4:
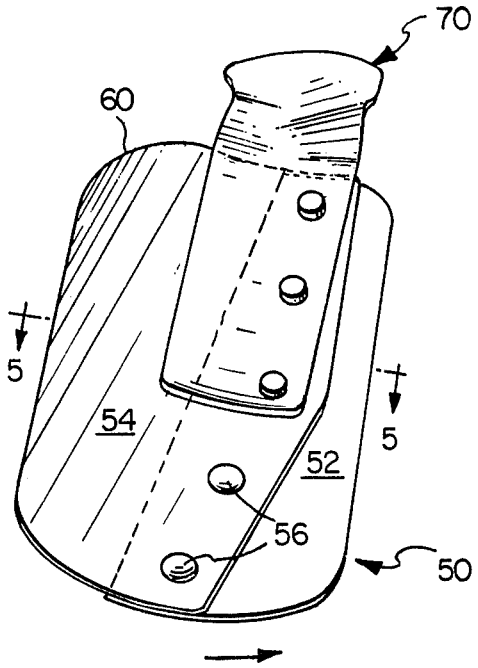
FIG. 4 is a perspective view illustrating another embodiment.
Figure 5:
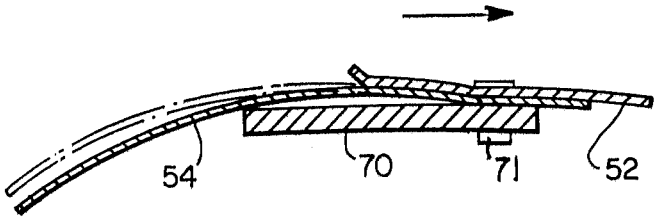
FIG. 5 is a view taken along section 5—5 of FIG. 4.

Referring now to FIGS. 4 and 5 of the drawings, another embodiment is illustrated. A blade is shown secured to a spider mounting arm 70, the upper end of which is adapted to be secured to a rotary hub. The arm is, typically, rectangular in cross-section and carries three apertures corresponding and aligned with apertures 58. Rivets 71 secure the arm to the fan blade. The flexible portion 54 is arcuate in cross-section and fastened to the spider so that one edge portion of arm 70, the lower left arm portion as viewed in FIG. 4, abuts a surface portion of the flexible blade 54. The resulting contact is resilient, such that external force is required to bend or flex the blade portion 54 from its solid to the dashed position indicated. Further, if the left (abutment) portion of arm 70 at FIG. 5 were removed, the blade would assume its unstressed position, with the left (FIG. 5) edge of the blade 54 moving counterclockwise somewhat. The blade is thus prestressed. The securing force of fasteners 71 and the different curvature of the resilient blade and its facing arm portion give rise to the biasing force. Hence, greater force is required to flex it from its solid to its dashed line position than if it were unstressed. In operation, centrifugal and air reaction forces acting on the blade during rotation of the arm 70 with its (not illustrated) hub force, once a certain or predetermined speed has been reached, moves the blade from the solid to the dashed position to thereby effectively diminish its pitch.

Advantages of such prestressing are reduced pitch back upon acceleration of the fans rotational speed, less vibration, and superior control of the blade flexure.

While the prior art is aware of prestressed, flexible fan blades, the present construction is simpler. In U.S. Pat. No. 2,132,133 to Smith, a longitudinal pivot hinges a blade portion to a rigid leading edge and a coil spring generates the biasing force. In U.S. Pat. No. 3,679,321, to Strick, a separate sheet metal resilient biasing element is inserted between the mounting arm and the flexible blade and bears against the latter. While apparently satisfactory for the purposes intended by the inventors, the requirement of a separate biasing member obviously increases difficulties of assembly and cost. The present invention requires no separate or additional bias members, it utilizes the inherent resiliency of the flexible portion of the blade.

The reader will recognize that the biasing arrangement shown at FIGS. 4 and 5 is employed with the blade construction illustrated at FIGS. 1 and 3. However, this biasing arrangement may also be employed in conjunction with nearly all flexible fan blade constructions. Thus, the embodiment of FIGS. 4 and 5 may be used with blades of any twist or configuration. The only requirement is that the fastening of the flexible blade to its spider mounting arm causes a prestress in the blade. For example, the flexible blade could be flat and the facing spider arm surface curved, i.e., an inverse of the arrangement of FIG. 5. Further, the mounting arm and flexible blade may resiliently abut each other over a surface, along a line, or at a point. Thus, referring now to FIG. 4, the abutment may occur only at a small zone or point at the lower left part of arm 70, or along a narrow zone or line along the left edge of the arm, or over a larger surface area of the arm. The same is true with respect to the blade. If the blade and/or its rigid mounting arm are twisted to effect the bias, the bias will follow if twist angle of one differs from the twist angle of the other. It will also be apparent that the resilient biasing arrangement here described may be employed with a composite blade, i.e., one having a stiffened, separate leading edge portion, or with a blade defined solely by a flexible sheet metal workpiece having a stiffened leading edge.

What is claimed is:

1. A fan blade construction adapted for use in an internal combustion engine, a flexible fan blade having a stiffened leading edge, the blade adapted to be coupled to a rotatable hub by means of mounting arms, a rigid mounting arm, the flexible blade rigidly secured to the mounting arm, said flexible blade having an abutment portion which resiliently bears against an abutment portion of said arm at a region spaced from the rigid securement of the blade to the arms, whereby upon rotation of the flexible blade air reaction forces and centrifugal forces above a predetermined amount flex the flexible blade away from its arm abutment to thereby diminish its effective pitch, said flexible blade being arcuate in cross-section with its concave side facing one side of said mounting arm, and defining a space therebetween, said arm and blade secured together in overlapped and parallel relation along one edge of said arm, at least a portion of the other edge of said arm defining said arm abutment portion.

2. The fan blade construction of claim 1 wherein said blade is twisted so that the abutment portion of the arm is at an outer corner thereof.

3. The fan blade construction of claim 1 wherein the facing surfaces of the blade and of the rigid mounting arm are of differnet radii of curvature to cause said abutment.

4. The fan blade construction of claim 1 wherein the rigid mounting arm is formed at a twist angle different from the twist angle of the flexible blade to cause said abutment.

* * * * *